US007357055B2

(12) United States Patent
Saelen et al.

(10) Patent No.: US 7,357,055 B2
(45) Date of Patent: Apr. 15, 2008

(54) THREE KNIVES CUTTING

(75) Inventors: Marc Saelen, Allennes-les-Marais (FR); Jean-Yves Delattre, Fournes-en-Weppes (FR); Bernard Freycon, La Neuville (FR)

(73) Assignee: Visteon Global Technologies, Inc., Van Buren Township, MI (US)

( * ) Notice: Subject to any disclaimer, the term of this patent is extended or adjusted under 35 U.S.C. 154(b) by 0 days.

(21) Appl. No.: 10/019,992

(22) PCT Filed: Mar. 22, 2001

(86) PCT No.: PCT/US01/09103

§ 371 (c)(1),
(2), (4) Date: May 6, 2002

(87) PCT Pub. No.: WO01/70470

PCT Pub. Date: Sep. 27, 2001

(65) Prior Publication Data

US 2002/0164224 A1 Nov. 7, 2002

(30) Foreign Application Priority Data

Mar. 22, 2000 (FR) ..... 00 03668

(51) Int. Cl.
*B26D 1/03* (2006.01)

(52) U.S. Cl. ..... 83/49; 83/56; 83/622

(58) Field of Classification Search ..... 83/49, 83/550, 622, 549, 916, 917, 56
See application file for complete search history.

(56) References Cited

U.S. PATENT DOCUMENTS 2,118,110 A 5/1938 Rosenberg
3,570,356 A * 3/1971 Williams et al. ..... 83/693
3,882,747 A 5/1975 Carli (Continued)

FOREIGN PATENT DOCUMENTS

EP 0 325 036 7/1989

(Continued)

OTHER PUBLICATIONS

Examiner Peterson's chisel set and workbench, pre-1995, one page.*

*Primary Examiner*—Kenneth E. Peterson
(74) *Attorney, Agent, or Firm*—Brinks Hofer Gilson & Lione

(57) ABSTRACT

The invention relates to a process and a device for producing a contour of a planiform piece, intended, in particular, for the internal trim of motor vehicles, in which the piece (1) is cut to define at least an apex (2) of the contour (3), having a given profile P, and a side (4), or so-called first side, of the contour (3) extending from the apex (2). According to the invention, there are carried out sequentially: on one hand, cutting of the piece (1) to produce simultaneously at least the apex (2), according to the profile P, and to cut the first side (4) over a portion, referred to as a fraction F, of its length extending from the apex (2); on the other hand, at least another operation of cutting the piece (1) to produce the first side (4), including at least a portion at least of the fraction F.

6 Claims, 2 Drawing Sheets

U.S. PATENT DOCUMENTS 4,250,786 A 2/1981 Bleich
4,539,880 A 9/1985 Barber et al.
4,623,089 A * 11/1986 Scott ..... 234/114
4,696,211 A * 9/1987 Bitzel ..... 83/49
4,729,273 A 3/1988 Fazis
4,738,173 A * 4/1988 Kiuchi ..... 83/34
4,869,141 A * 9/1989 Klingel ..... 83/49
4,967,626 A 11/1990 Doster et al.
5,044,239 A * 9/1991 Endo et al. ..... 83/133
5,113,733 A 5/1992 Peterson et al.
5,195,413 A * 3/1993 Johnson ..... 83/132

FOREIGN PATENT DOCUMENTS

WO WO 01/70470 9/2001

* cited by examiner

THREE KNIVES CUTTING

TECHNICAL FIELD

The invention relates to a process and a device for producing the contour of a planiform piece, intended, in particular, for the interior fittings of motor vehicles.

BACKGROUND

The expression "planiform piece" is to be taken as meaning a piece the thickness is very considerably less than the other dimensions, said piece not necessarily being flat but possibly having inwardly and /or outwardly facing deformations.

Although more particularly provided for pieces intended for the interior trim of the bodywork of motor vehicles passenger compartments such as, for example, door panels, cabinet-work or dashboards, the invention can be used in any other field.

At the present time, when it is wished to obtain a piece the contour of which has apices of a particular profile, in particular rounded, use is made of knives corresponding to each of the sides of the piece and all or part of the apices located at each end of the side cut. The knives are actuated simultaneously, in a direction substantially orthogonal to each of the sides. When they are in contact with the piece, their lateral ends are contiguous and in contact, two by two, in the area of a point located along the profile of the apices.

A first drawback of this process is that leads to marking, or even incorrect cutting of the part, owing to unsatisfactory cut joins in the area of the point of contact of the knives. Furthermore, when the knives approach on either side, one observes, at the apices, a pushing back of the parts of the piece to be cut, which can be prejudicial to the definition of the contour and to the cut.

SUMMARY OF INVENTION

The object of the present invention is to provide a process and device for producing a contour of a planiform piece, in particular intended for the interior fittings of motor vehicles, that remedy the aforementioned drawbacks and make it possible to improve the aesthetic appearance of said contour by improving the cut and, consequently, reducing the visibility of the joins.

Another object of the present invention is to provide a process and a device for producing a contour of a planiform piece intended, in particular, for the interior fittings of motor vehicles, that make it possible to prevent the pushing back of the parts of the piece to be cut.

Further objects and advantages of the invention will emerge from the following description which is provided solely by way of illustration and is not intended to limit same.

The invention relates, firstly, to a process for producing a contour of a planiform piece, intended, in particular, for the internal trim of motor vehicles, in which said piece is cut to define at least an apex of said contour, having a given profile P, and a side, or so-called first side, of said contour extending from said apex, characterised by the fact that there are carried out sequentially:

- on one hand, cutting of said piece to produce simultaneously at least said apex, according to said profile P, and to cut said first side over a portion, referred to as a fraction F, of its length extending from said apex, or so-called extended cutting operation,
- on the other hand, at least another operation of cutting said piece to produce said first side, including at least a portion at least of said fraction F, or so-called lateral cutting operation, or vice versa.

The invention also relates to a device for producing a contour of a planiform piece, intended, in particular, for the interior trim of motor vehicles, including means for cutting said piece, suitable for defining at least an apex of said contour, having a given profile P, and a side, or so-called first side, of said contour extending from said apex, characterised by the fact that said cutting means include at least:

- first means for cutting said piece, capable of permitting the simultaneous production of at least said apex, according to said profile P, and of said first side on a part, referred to as fraction F, of its length, extending from said apex,
- second means for cutting said piece, capable of permitting the production of said first side including at least one part at least of fraction F,
- said first and second cutting means functioning sequentially one after the other, or vice versa.

BRIEF DESCRIPTION OF DRAWINGS

The invention will be more readily understood from a study of the following description, accompanied by the annexed drawings which form an integral part thereof and wherein.

DETAILED DESCRIPTION OF INVENTION

The invention relates firstly to a process for producing a contour of a planiform piece intended, in particular, for the interior trim of motor vehicles.

Figure 1:
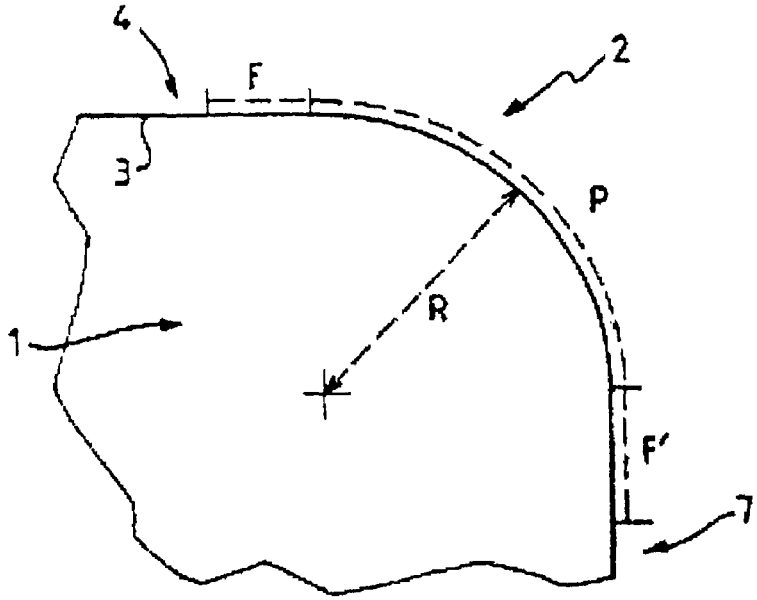
FIG. 1 is a top view or a part of a contour example obtained according to the process of the invention.

As illustrated in FIG. 1, according to the process of the invention, said piece 1 is cut to define at least an apex 2 of said contour 3, having a given profile P and a side 4, or so-called first side, of said contour 3 extending from said apex 2.

This is, for example, a rounded profile, in particular a quadrant-shaped profile, connecting two sides that are substantially rectilinear, at least partially from said apex. However, other profiles can be contemplated.

Figure 2:
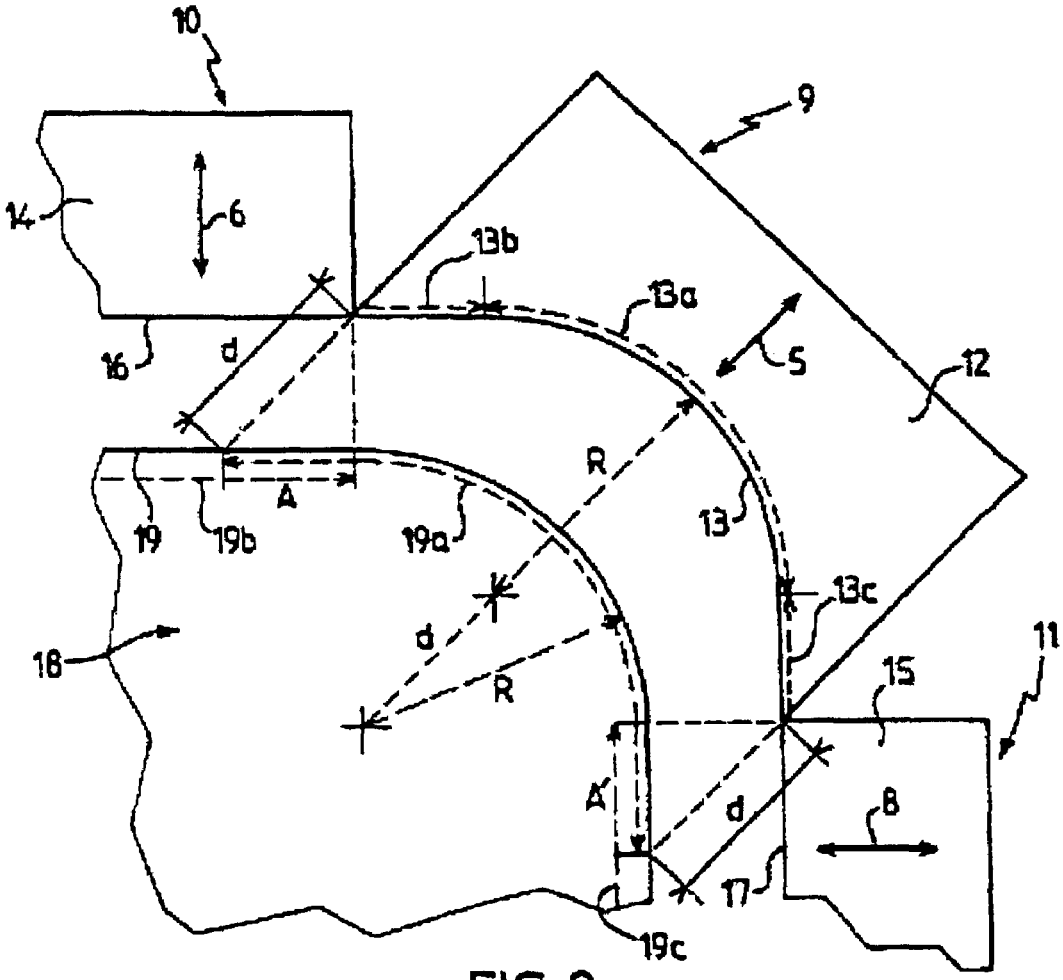
FIGS. 2 to 4 are top views, in different configurations, of an exemplary embodiment of the device according to the invention enabling the contour shown in preceding FIG. 1 to be obtained.
Figure 3:
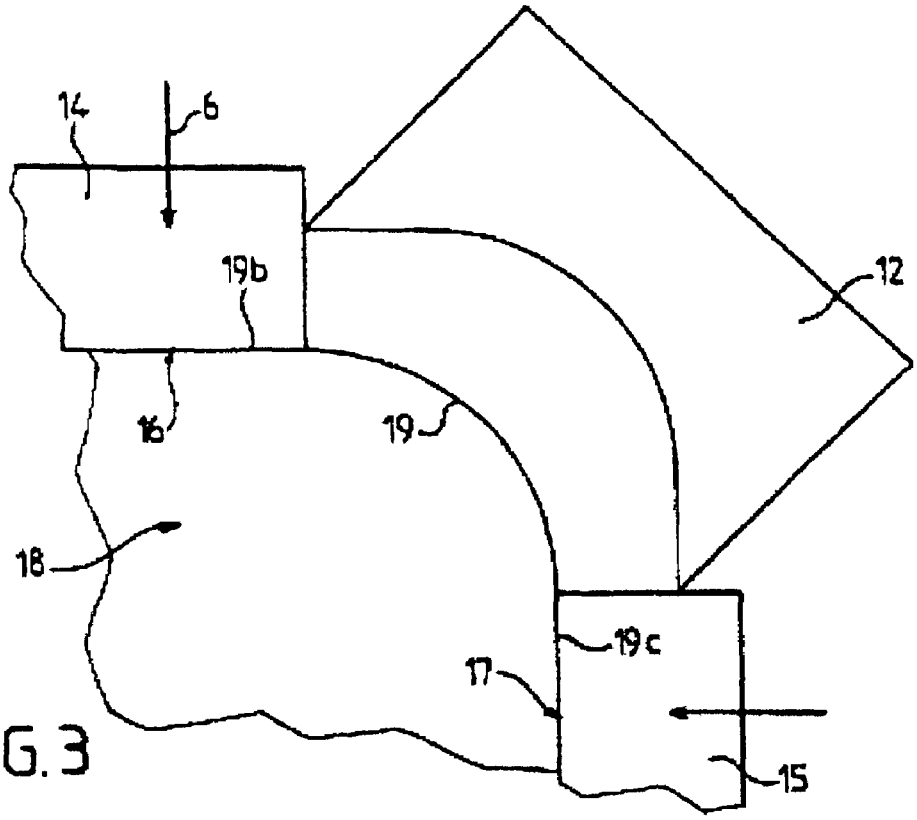
Figure 4:
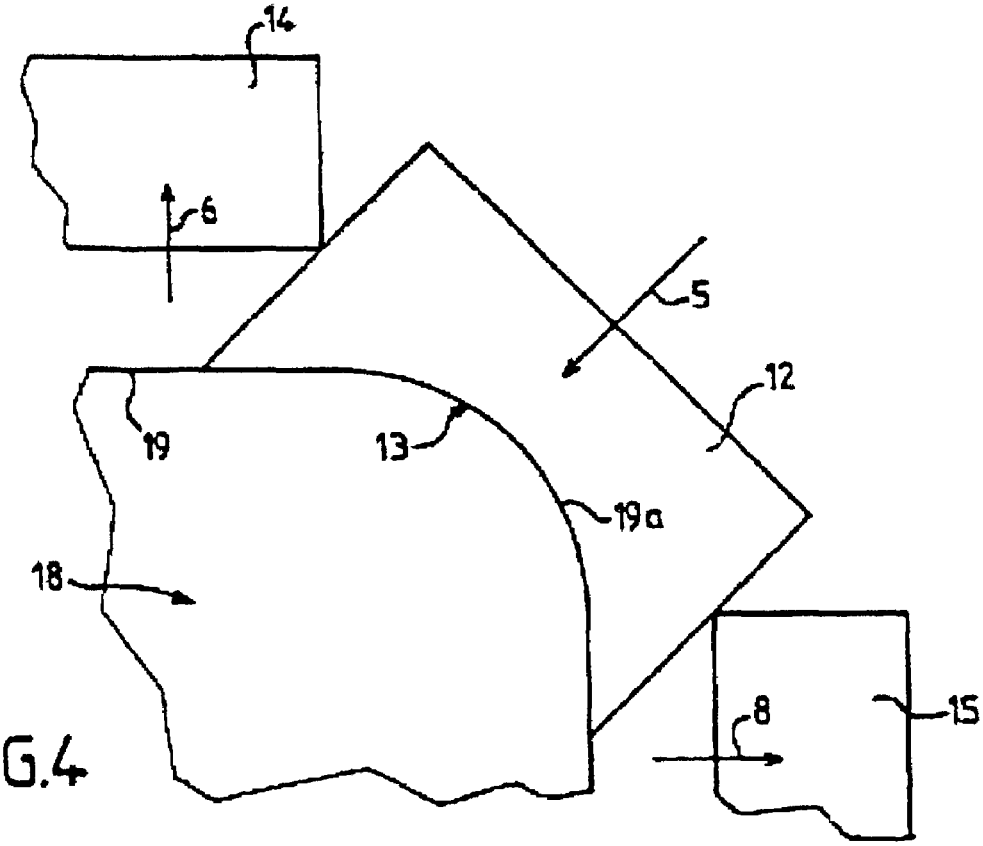

As illustrated in FIGS. 2 to 4, according to the invention, there are carried out sequentially, on one hand, cutting of said piece 1 to produce simultaneously at least said apex 2, according to said profile P, and to cut said first side 4 on one part, referred to as fraction F, of its length, extending from said apex 2. This operation, referred to hereinafter as "extended cutting of apex 2", is carried out, for example, in a first direction 5.

Furthermore, at least another operation of cutting said piece 1 is carried out to produce said first side 4 including at least one part at least of said fraction F. This operation, referred to hereinafter as the "first lateral cutting operation", is carried out, for example, in a second direction 6, other than said first direction.

Thus, according to the invention, the effects of the cutting operations overlap in the area of fraction F, which makes it possible to enhance the aesthetic appearance of the join.

In the event of the presence of another side 7, or so-called second side, of contour 3 extending from said apex 2, in particular in a direction other than that of said first side 4, said second side can be produced simultaneously, at the time of said extended cutting operation, on a part called F' of its length, extending from said apex.

Additional cutting is then effected, at another time, of said piece 1 to produce said second side 7 at least in the area of a part of said fraction F'. This operation, referred to as the "second lateral cutting operation", is carried out, for example, in a third direction 8, other than said first and said second directions 5, 6.

According to one particular embodiment, at the time of said first and second lateral cutting operations, said piece 1 is cut out over the entire length of said fractions F, F'.

As more particularly illustrated in FIGS. 3 and 4, said first and second lateral cutting operations can be effected simultaneously, before said extended cutting of apex 2.

This being the case, according to other forms of embodiment, it is possible, on the contrary, to begin with said extended cutting of apex 2.

Furthermore, as described in greater detail elsewhere, said contour 3 can be produced on one part only of the thickness of said piece 1.

In the case of a polygonal piece, in particular a rectangular one, all or part of the apices can be produced by effecting for each of the desired apices said extended cutting operation. A side located between two apices thus obtained is produced, for example, by said first lateral cutting of one of the two apices and by said second lateral cutting of the other of said apices, carried out simultaneously.

The invention also relates to a device for producing a contour of a planiform piece, in particular for implementing the process described above.

It includes means for cutting said piece 1, capable of defining at least one apex 2 of said contour 3, having a given profile P, and a side 4, or so-called first side, of said contour 3, extending from said apex 2.

Said cutting means include at least:

first means 9 for cutting said piece, capable of permitting the simultaneous production of at least said apex 2, according to said profile P, and of said first side 4 on a part, referred to as fraction F, of its length, extending from said apex 2, as well as second means 10 for cutting said piece 1, capable of permitting the production of said first side 4 including at least a part of said fraction F.

Said first and second cutting means 9, 10 function sequentially one after the other, or vice versa.

Said first cutting means 9 can be capable of permitting the simultaneous production, furthermore, of another side 7, or so-called second side of contour 3, extending from said apex 2, over a part referred to as fraction F', of its length, extending from said apex 2.

Said cutting means then include third means 11 for cutting piece 1, capable of permitting the production of said second side 7 including at least a part of said fraction F', said first cutting means 9 and said third cutting means 11 functioning sequentially one after the other, or vice versa.

Said second and third cutting means 10, 11 are designed to be capable of producing said first and second sides 4, 7, for example, over the entire length of their fraction F, F', at least. They are further designed to be capable of being, in particular, actuated simultaneously, for example after said first cutting means 9.

Said first, second and third cutting means 9, 10, 11 are mobile, in particular, in a first, second and third direction, 5, 6, 8, that are different from one another.

Said first cutting means 9 are constituted, in particular, by a knife 12, or so-called first knife, provided with a cutting portion 13, having a continuous cutting edge 13 formed of three parts, a first central part 13*a*, capable of permitting the formation of apex 2 according to profile P, and a second and a third part, 13*b*, 13*c*, extending on either side said central part 13*a*, capable of permitting, respectively, the formation of fractions F and F'.

Said second and third cutting means 10, 11, are each constituted by a knife, 14, 15, referred to respectively as second and third knives, having a cutting edge 16, 17, capable of permitting the formation, respectively, of said first and second sides at least in the area of a part of said fractions F, F', respectively.

Said cutting means can, furthermore, include, as appropriate, a support 18, capable of receiving said piece 1, so that the latter can be sandwiched at least over a part of its thickness, between said support 18 and said first, second and third cutting means 9, 10, 11.

Said support 18 will be constituted, for example, by the mould in which said piece 1 has been formed, with the parts to be cut off said piece 1 projecting from said mould. This will involve, in particular, the punch of said mould.

As illustrated in FIG. 2, said support 18 has, for example, a contour including at least a first part 19*a* having a profile that is substantially identical, or even identical, with that of cutting edge 13 of the first knife 12, and a second and third part 19*b*, 19*c*, located on either side of said first part 19*a* of the contour of the support in the prolongation thereof. Said second and third parts of the contour of the support have a profile that is substantially identical, or even identical, respectively, with that of the cutting edges of said second and third knives 14, 15.

Said first and second parts 19*a*, 19*b* overlap in the area of a first zone A, capable of permitting the formation of fraction F. Said first and third parts of the contour of support 19*a*, 19*c* overlap in the area of a second zone A' capable of permitting the formation of fraction F'.

Said first, second and third knives 12, 14, 15 are mobile between two positions in relation to said support 18, namely, for example, a first retracted position in which the cutting edges 13, 16, 17 of said first, second and third knives are contiguous and in the prolongation of one another, respectively facing said first, second and third parts 19*a*, 19*b*, 19*c* of the contour of the support.

The spacing between support 18 and the first, second and third knives 12, 14, 15 is not constant and will depend on profile P of the apex. However, it is to be noted that the panel to be cut is held satisfactorily during sequential cutting, the panel being entirely held between the cutting means, this preventing the pushing back of the parts to be cut out.

In their second position, said first, second and third knives 12, 14, 15 are in contact with said support 18, with said first knife 12 coming to bear, in a first configuration illustrated in FIG. 4, against the first part 19*a* of the contour of the support and said second and third knives 14, 15 coming to bear, in a second configuration illustrated in FIG. 3, against said second and third parts 19*b*, 19*c* of the contour of the support.

In the case, mentioned earlier, of a piece 1 having a contour 3 with an apex 2 in the form of a quadrant extended by substantially rectilinear first and second sides 4, 7, support 18 will then have, in particular, an identical contour 19. As to first knife 12, its cutting edge will have a first part 13*a* in the shape of a quadrant extended by a second and a third part, 13*b*, 13*c*, with the dimensions of fractions F and F'. Said first knife 12 is mobile, in particular, along the axis of symmetry of said quadrant.

In retracted position, the centre of the quadrant defining the contour of support 18 and the centre of the quadrant defining the first part 13*a* of the cutting edge of first knife 12, both having a radius "R", are offset by a distance "d" in order to enable said first knife 12 to be brought to bear against said support 18 in the area of said first, second and third parts 13*a*, 13*b*, 13*c* of its contour. Said second and third knives 14, 15 can, as applicable, permit the production of said first and second sides 4 7 over their entire length. They are mobile, substantially, along the perpendicular to said sides.

As mentioned earlier, said cutting means can cut piece 1 only over a part of its thickness. In particular, when the latter is constituted by a layer of support material lined with a cladding sheet, the first, second and third knives 12, 14, 15 can be positioned between said support and said cladding sheet before cutting so as to cut only said support.

Other forms of embodiment, within the grasp of a person skilled in the art, could, of course, have been developed without thereby departing from the scope of the invention.

The invention claimed is:

1. A method for producing a contour of a planiform piece for an interior trim of a motor vehicle, the method comprising:

cutting said planiform piece with a first cutting means to simultaneously produce at least an apex having a rounded profile P and a first portion of a first straight side extending from said apex, said step of cutting with the first cutting means includes cutting a first portion of a second straight side extending from said apex;

cutting said planiform piece with a second cutting means to produce a second portion of the first straight side, the second cutting means having a different configuration than the first means and overlapping a part of the first portion of the first straight side formed by the first cutting means;

cutting said planiform piece using a third cutting means to produce a second portion of the second straight side, the third cutting means overlapping a part of the first portion of the second straight side formed by the first cutting means;

receiving said piece using a support portion such that the piece can be sandwiched, at least over a part of its thickness, between said support and said first, second and third cutting means;

said receiving step receiving said piece with a support having a contour including at least a first part, having a profile substantially identical with that of the cutting edge of the first cutting means, and a second end a third part located on either side of said first part of the contour of the support in the prolongation of the latter and having a profile substantially identical, with that of the cutting edges of the second and third cutting means; and wherein said first and second cutting means function sequentially and wherein said first and third cutting means function sequentially.

2. The method according to claim 1, wherein said first cutting means has a continuous cutting edge formed of three parts, a first central part for forming the apex according to the profile P, a second part extending on one side of said first central part for forming the first portion of the first straight side and a third part extending on an opposing side of the first central part for forming the first part of the second straight side.

3. The method according to claim 1, wherein cutting said piece using said first cutting means further comprises cutting the piece with a first curved knife having a continuous cutting edge formed of three parts, including a first central part for forming the apex, a second and a third part extending on each side said central part, for forming portions of said first and second sides.

4. The method according to claim 1, wherein cutting said piece using the first cutting means further comprises receiving said piece using a support portion of said first knife such that the piece can be sandwiched, at least over a part of its thickness, between said support and said first cutting means.

5. The method according to claim 1, further comprising actuating said first, second and third cutting means between two positions in relation to said support, such that a first retracted position in which the cutting edges of said first, second and third cutting means are contiguous and in the prolongation of one another, and facing said first, second and third parts of the contour of the support, and wherein a second position in which the cutting edges are in contact with said support, said first cutting means coming to bear, in a first configuration, against said first part of the contour of the support, and said second and third cutting means coming to bear, in a second configuration, against said second and third parts of the contour of the support.

6. A method for producing a contour of a planiform piece for an interior trim of a motor vehicle, the method comprising:

cutting said planiform piece with a first cutting means to simultaneously produce at least an apex having a rounded profile P and a first portion of a first straight side extending from said apex, said step of cutting with the first cutting means includes cutting a first portion of a second straight side extending from said apex;

cutting said planiform piece with a second cutting means to produce a second portion of the first straight side, the second cutting means overlapping a part of the first portion of the first straight side formed by the first cutting means;

cutting said planiform piece using a third cutting means to produce a second portion of the second straight side, the third cutting means overlapping a part of the first portion of the second straight side formed by the first cutting means;

receiving said piece using a support portion such that the piece can be sandwiched, at feast over a part of its thickness, between said support and said first, second and third cutting means;

actuating said first, second and third cutting means between two positions in relation to said support, such that a first retracted position in which the cutting edges of said first, second and third cutting means are contiguous and in the prolongation of one another, and facing said first, second and third parts of the contour of the support, and wherein a second position in which the cutting edges are in contact with said support, said first cutting means coming to bear, in a first configuration, against said first part of the contour of the support, and said second and third cutting means coming to bear, in a second configuration, against said second and third parts of the contour of the support; and wherein said first and second cutting means function sequentially and wherein said first and third cutting means function sequentially.

* * * * *

UNITED STATES PATENT AND TRADEMARK OFFICE

CERTIFICATE OF CORRECTION

PATENT NO. : 7,357,055 B2
APPLICATION NO. : 10/019992
DATED : April 15, 2008
INVENTOR(S) : Marc Saelen et al.

It is certified that error appears in the above-identified patent and that said Letters Patent is hereby corrected as shown below:

In the Claims

Column 6, in claim 6, line 21, before "over a part" delete "feast" and substitute --least-- in its place.

Signed and Sealed this

Nineteenth Day of August, 2008

JON W. DUDAS
*Director of the United States Patent and Trademark Office*